United States Patent [19]

Brooks

[11] 4,357,216

[45] Nov. 2, 1982

[54] METHOD FOR ELECTROFORMING A REPLICA ON A RECORD MATRIX

[75] Inventor: William C. Brooks, Brownsburg, Ind.

[73] Assignee: RCA Corporation, New York, N.Y.

[21] Appl. No.: 307,011

[22] Filed: Sep. 30, 1981

[51] Int. Cl.[3] ..... C25D 1/20

[52] U.S. Cl. ..... 204/5

[58] Field of Search ..... 204/5, 14 R, 23

[56] References Cited

U.S. PATENT DOCUMENTS 2,075,646 3/1937 Hewitt ..... 204/5

2,530,842 11/1950 Ruggieri ..... 204/5

*Primary Examiner*—T. Tufariello

*Attorney, Agent, or Firm*—Birgit E. Morris; Edward J. Sites

[57] ABSTRACT

An improved method is provided for the manufacture of records, molds, and stampers in which the matrix on which the molds and stampers are electroformed is subjected to demagnetization prior to electroforming to prevent tramp metal particles from adhering to the surface of the matrix and thereby causing microdefects in the electroformed parts.

6 Claims, 8 Drawing Figures

METHOD FOR ELECTROFORMING A REPLICA ON A RECORD MATRIX

This invention relates to an improved method for electroforming a replica on a record matrix and more particularly is concerned with an improvement in the method which reduces or eliminates certain types of microdefects.

BACKGROUND OF THE INVENTION

Molded records, such as conventional audio records or the more recently developed video discs, are manufactured in a process in which a molding composition is pressed between a pair of metal plates referred to as stampers. The stampers have defined in their molding surfaces a spiral groove which contains a surface relief image defined in either the side walls or the base of the groove which corresponds to the information desired to be reproduced on playback of the record. The spiral groove in the record is used to guide the stylus of the playback apparatus. In order to obtain proper playback of the record, it is important that the stylus precisely follow the spiral groove in a continuous manner. If the stylus is caught in a given groove, a condition known as "lock groove" occurs where the record does not play continuously but rather repeats a given portion of the recording. A further type of defect which is encountered is known as "skip groove", where, as the name implies, the stylus skips over a series of grooves causing a discontinuity in playback.

It has been found that many times the defects encounted in playback, such as lock groove and skip groove, are caused by microdefects molded into the record. The microdefects typically are present in the molded surface of the record as either pits or as bumps blocking one or more grooves. The microdefects which are molded into the record are a very serious problem in that records having these defects must be scrapped.

Microdefects molded into a record can often be traced directly back to the stamper used to press the record, in that many times the stamper will be found to have similar mating microdefects defined in the molding surface of the stamper.

Many of the microdefects found in the stampers can, in turn, be traced back to the mold on which the stamper was electroformed. However, surprisingly, a substantial number of the microdefects found in the stampers cannot be traced back to the mold.

In a like manner, many of the microdefects found in the molds, such as pits and bumps, in many cases cannot be traced back to the master on which the molds were electroformed.

Based on the progressive appearance of the microdefects from the master to the molds and from the molds to the stampers, it was thought that the microdefects were caused by some problem which occurred during the step of electroforming the molds on the masters and the stampers on the molds. Those skilled in the art, however, were unable to specifically identify much less correct the problems in the electroforming procedure, and molded records exhibiting lock groove, skip groove, and the like caused by the microdefects, such as the pits and bumps continued to be a major cause of rejection of the molded records.

Accordingly, it would be highly advantageous if an improvement in electroforming processes could be found which would eliminate or substantially reduce microdefects.

BRIEF SUMMARY OF THE INVENTION

It has been found that certain types of microdefects can be eliminated or substantially reduced by demagnetizing the matrix used in the electroforming process prior to the actual electroforming of a replica on the surface of the matrix.

DETAILED DESCRIPTION OF THE INVENTION

Nickel is one of the most commonly used metals employed in the matrixing process used for the manufacture of the masters, molds and stampers employed in the record manufacturing art. Other commonly used metals are, for example, nickel alloys, iron alloys, and the like. The metals which are commonly used for the electroforming of the matrixes and, in particular, nickel have the capability of becoming magnetized under the conditions encountered in the electroforming process.

Figure 1:
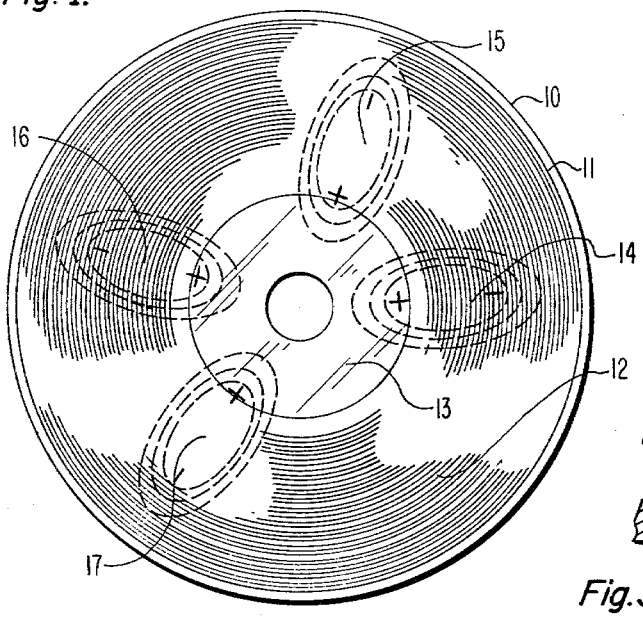
FIG. 1 is a top plan view of a record matrix showing zones of high magnetism.
Figure 2:
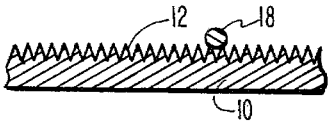
FIG. 2 is a cross-sectional illustration of a portion of a matrix with a particle shown magnetically adhered to the grooved surface of the matrix.
Figure 3:
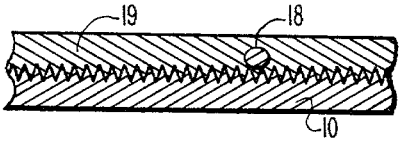
FIG. 3 is a cross-sectional illustration of the matrix of FIG. 2 having a replica electroformed on the surface thereof.
Figure 4:
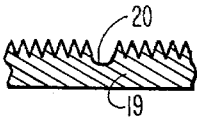
FIG. 4 is a cross-sectional illustration of a first type of electroformed replica removed from the matrix.

In an effort to determine the cause of microdefects found in the molded records, an evaluation was made of the properties of the matrixes used in the electroforming process, as well as the plating baths, wash baths, and the overall environment in the plating area. As a result of this investigation, it was found that the masters, molds, stampers are often formed in the electroforming process with zones of relatively high magnetism. Referring to FIG. 1, there is illustrated a typical matrix 10 having an edge portion 11, a grooved recorded area 12, and a center portion 13. On the surface of the matrix 10 there is shown, for purposes of illustration, zones of magnetism 14, 15, 16, 17 which exhibit relatively high magnetic energy. For purposes of illustration, magnetic poles are indicated by plus (+) and minus (−) signals. However, it should be appreciated that the polarity signs could be and often are reversed on a given matrix. Furthermore, the zones of magnetism 14, 15, 16, 17 can be present in more or less areas than that illustrated, and can also be at different areas of the matrix 10. The presence of the zones of magnetism 14, 15, 16, 17, the position of these zones, and the relative magnetic strength of the zones can readily be determined with a commercially available magnetism meter. However, for the purposes of this invention, it should be appreciated that the exact number, strength, and position of the zones of magnetism is not important, but rather it is only important to determine if zones of magnetism in fact exist on a given matrix 10.

As a further result of the study conducted with regard to the microdefects, it was found that the plating baths, the wash baths, and even the general environment in the plating area inherently contain minute particles of tramp nickel, iron and other magnetically attractable metals. The particles are often so small as to almost avoid detection. The particles are apparently produced as a result of handling of the nickel parts, such as when separating the electroformed parts from the matrix and other related operations encountered in the electroforming process.

It was then found that the extremely small particles 18 from the environment and from the plating baths and wash baths are attracted to and adhered to the surface of the matrix at the zones of magnetism 14, 15, 16, 17 prior to and during the initial step of electroforming. The particles 18 often adhere so strongly to the grooved area 12 of the matrix 10, that the particles 18 resist removal in the prerinse steps in the electroforming process. The tiny particles 18 then are plated over when a replica 19 is electroformed from the matrix 10.

When the replica 19 is separated from the matrix 10, the particle 18 will either leave its impression in the replica 19 in the form of a pit 20 or, in the alternative, the particle also will be plated into the replica 19 as a bump 21 on the surface of the replica 19.

If the replica 19 is a mold, the defect in the form of a pit 20 or a bump 21 will then be propagated through the remainder of the parts generated from that mold, such as the stampers formed on the mold, and then the records molded with the stampers. In the same manner, if the microdefect 20, 21 caused by the particle of metal 18 first occurs in the stamper, it will then be molded into all the records molded on the surface of the stamper.

Figure 5:
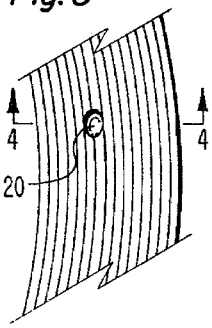
FIG. 5 is a top plan view of a portion of the electroformed replica which corresponds to FIG. 4.
Figure 7:
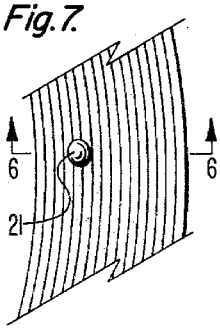
FIG. 7 is a top plan view of the portion of the electroformed replica corresponding to FIG. 6.
Figure 6:
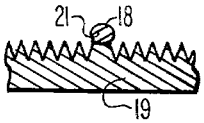
FIG. 6 is a second type of electroformed replica taken from the matrix illustrated in FIG. 2.

Referring to FIGS. 5 and 7, it can be seen that a pit 20 or a bump 21 effectively prevents the proper tracking of a stylus on playback of a record molded with a stamper having this type of microdefect as a result of either lock groove or skip groove.

It has now been found that microdefects of the type noted above can effectively be eliminated or substantially reduced by demagnetizing the matrix 10, whether it be the master or the mold, as one of the initial steps in the matrixing process.

Figure 8:
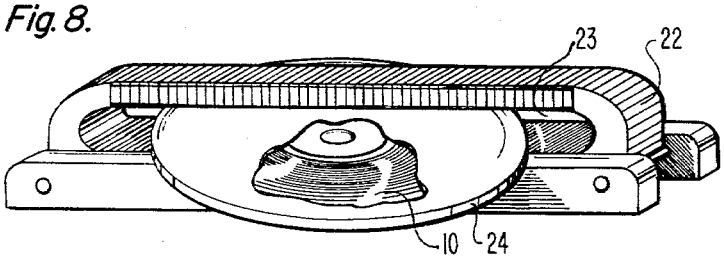
FIG. 8 is a pictorial illustration of the demagnetization of a record matrix conducted in accordance with the teachings of this invention.

Suitable apparatus for use in demagnetizing the matrix 10 is readily obtainable from commercial sources, or can readily be fabricated without great difficulty. While various configurations of demagnetizers can be successfully used for the demagnetization of the matrixes in accordance with this invention, it has been found that the concentrated-field open-type demagnetizers are preferred because of the simplicity of operation. In FIG. 8 there is illustrated a typical open-type demagnetizer 22. The demagnetizer 22 is connected to a power source (not shown) which typically can be, for example, a 115 volt, 60 hertz electric source. The demagnetizer 22 has a center passage 23 which is somewhat wider than the diameter of the matrix 10 to be demagnetized. For the typical record matrixes which are about 13 to 14 inches (33 to 35 centimeters) in diameter, a center passage which is about 4 inches (10 centimeters) in height and about 18 inches (46 centimeters) in width has proven to be most satisfactory. Referring specifically to FIG. 8, in the center passage 23 of the demagnetizer there is shown a plastic case 24, with parts broken away for purposes of illustration, in which a matrix 10 to be demagnetized is enclosed. The case 24 should be made of plastic or another similar material which cannot be magnetized, rather than of a magnetizable metal such as steel, in that if, for example, a steel case is used, the demagnetization force can cause the matrix to be violently moved within the case and cause physical damage to the matrix 10. The plastic case 24 is preferably used in accordance with this invention in order to protect the matrix from being damaged as a result of handling by the operators or by physical contact with the demagnetizer 22. It should be noted, however, that the matrix 10 can be demagnetized without the use of a case by carefully holding the matrix and rotating it through the passage 23 of the demagnetizer 22.

In practice, the demagnetizer is energized. Then, the matrix 10 is placed in the case 24. The matrix 10 in the case 24 is then inserted into the passage area 23 of the demagnetizer 22. The matrix within the case is then rotated within the passage 23 of the demagnetizer 22 so that all sections of the matrix 10 are at least momentarily oriented parallel with the actual demagnetizing field of the demagnetizer 22.

The case 24 with the matrix inside is then removed from the demagnetizer 22. The matrix 10 can then be checked with a magnetism meter to determine if any residual zones of high magnetism still exist. If zones of high magnetism are still present on the matrix, a second pass can be made through the demagnetizer 22. However, generally one pass through the demagnetizer 22 is quite sufficient to remove the zones of high magnetism 14, 15, 16, 17.

It should be noted that in order to obtain optimum results with the method of this invention, it is preferable to demagnetize the matrix 10 each time a replica 19 is to be formed on the matrix 10.

The matrixes treated in accordance with this invention have been found to have no magnetic attraction for the tramp metals found in the environment, plating baths, wash baths, and the like. Furthermore, the replicas formed on the demagnetized matrixes have been found to have significantly fewer microdefects and to be essentially free of the pits 20 and the bumps 21 characteristically encountered with the matrixes having areas of high magnetism. In addition, records molded with the stampers treated in accordance with this invention have been found to exhibit significantly fewer problems with regard to lock groove, skip groove, and other similar problems.

What is claimed is:

1. In a method for manufacture of record molding stampers wherein a replica is formed by electroplating a metal on a matrix made of magnetizable metallic material, the improvement which comprises subjectng the matrix to demagnetization until the matrix is free of zones of magnetism prior to electroforming the metal on the matrix.

2. The method according to claim 1 wherein the matrix is a master and the replica to be electroformed on it is a record mold.

3. The method according to claim 1 wherein the matrix is a record mold and the replica to be electroformed on the mold is a record molding stamper.

4. The method according to claim 1 wherein the magnetizable metallic material is nickel.

5. The method according to claim 1 wherein the matrix is subjected to demagnetization while protected in a case made of a non-magnetizable material.

6. The method according to claim 5 wherein the case is made of plastic.

* * * * *